United States Patent [19]

Shaw et al.

[11] Patent Number: 4,876,858

[45] Date of Patent: Oct. 31, 1989

[54] AIR CONDITIONER AND METHOD OF DEHUMIDIFIER CONTROL

[75] Inventors: Allan Shaw; Russell E. Luxton, both of 5th Floor, Security House, 233 North Terrace, Adelaide, Australia

[73] Assignees: Allan Shaw; Russell Estcourt Luxton; Luminis Pty. Ltd., all of Adelaide, Australia

[21] Appl. No.: 124,876

[22] Filed: Nov. 24, 1987

[30] Foreign Application Priority Data

Nov. 24, 1986 [AU] Australia ..... PH9126

[51] Int. Cl.[4] ..... F25D 17/06; F25B 41/04

[52] U.S. Cl. ..... 62/93; 62/117; 62/223

[58] Field of Search ..... 62/93, 117, 223, 199, 62/185; 236/1 EA

[56] References Cited

U.S. PATENT DOCUMENTS

| | | | |
|---|---|---|---|
| 2,614,394 | 10/1952 | McGrath | 62/93 |
| 2,960,840 | 11/1960 | Hosken et al. | 62/199 X |
| 3,069,867 | 12/1962 | Ringquist | 62/185 X |
| 4,259,847 | 4/1981 | Pearse, Jr. | 62/93 |
| 4,319,461 | 3/1982 | Shaw | 62/93 |

OTHER PUBLICATIONS

ASHRAE Handbook, Fundamentals, p. 4.7 (1985).

Shaw et al., "Latest Findings . . . Through Dehumidifier Coils", 8 pages, (1985).

Tamblyn, "Beating the Blahs for VAV," ASHRAE Journal, pp. 42–45, (Sep. 1983).

Shaw, "Exploration of Air Velocity . . . Conservation Project," ASHRAE Transactions, 15 pages (1982).

Shaw, "Airstream Velocity Across Dehumidifiers," Proceedings of the 7th International Heat Transfer Conference, Munich, vol. 6, 5 pages (Aug. 1982).

*Primary Examiner*—William E. Wayner

*Attorney, Agent, or Firm*—Baker, Maxham, Jester & Meador

[57] ABSTRACT

An air conditioner dehumidifier comprising coil portions cooled for example by chilled water or refrigerant. Under part load conditions, restriction of coolant flow below peak load flow, or its total elimination, is limited to some only of the coil portions, while the remainder may receive as much or more coolant flow as at peak load conditions. The relatively unrestricted coolant flow through this remainder can be greater than that under peak load conditions due to more pump output being available to supply the reduced active size of the coil.

2 Claims, 5 Drawing Sheets

AIR CONDITIONER AND METHOD OF DEHUMIDIFIER CONTROL

This invention relates to a new air conditioner and a new comprehensive method of air conditioning wherein a dehumidifier is controlled over varying load conditions to satisfy both sensible and latent heat loads under both peak load and part load conditions. Low energy consumption and improved performance are the major benefits.

BACKGROUND OF THE INVENTION

Numerous problems have arisen for both constant air volume and variable air volume systems due to the efforts to reduce the cost of energy, reduce the capital cost of installations and reduce the space requirements for the air conditioning systems. While some of these problems have been successfully resolved; others have been solved by means which have largely nullified the original design objectives, and, frequently degraded performance to an unacceptable level.

In particular, the following parameters require consideration:

(i) Coolant Flow Rate

The flow rate of coolant influences part load performance in marginal weather conditions. The higher the coolant velocity within the tubes of the dehumidifier, all other parameters being held constant, the steeper is the coil condition curve on a psychrometric chart; that is, the greater is the ratio of latent cooling (moisture removal) to sensible cooling.

Conventionally, whether the air conditioning system is a constant air volume system or a variable air volume system, it is common practice to effect control by reducing the volume flow rate of coolant through the tubes of the dehumidifier coil as the sensible cooling needs reduce. This reduces the cooling capacity of the coil but also reduces the rate at which heat can be transferred to the coolant by reducing the coolant-side heat transfer coefficient.

During part load weather conditions the transmission of sensible heat to the treated zone reduces, or may actually become negative and so cancel part of the internal sensible heat load. However latent heat addition (from people, infiltration and other sources) which occurs simultaneously and in parallel with the sensible transfer, will usually remain the same or may increase. It is quite common to have a part load condition wherein the ambient dry bulb temperature is lower and the dew point temperature is higher than at design peak conditions. Thus there is a decreased sensible heat load and an increased latent heat load. The dehumidifier must then operate at a new ratio of latent to sensible heat transfer and hence the slope of the coil condition curve is required to be steeper.

(a) Conventional Coolant Flow Rate for Constant Air Volume (CAV) Systems

In constant air volume systems the conventional airstream velocity entering the face of the dehumidifier coil, hereinafter referred to as the "face velocity", does not vary with the load. A reduced load is offset by throttling the coolant flow to the dehumidifier. As a result, the temperature of the surface of the dehumidifier rises resulting in the temperature of the air leaving the dehumidifier being higher than with unrestricted coolant flow. This can only be a satisfactory means of accommodating reduced loads if the zone latent heat loads are insignificant and the ambient air at part load is dry, but such conditions are very unusual. The reduced coolant flow causes the surface temperature to rise as a result of the decrease in coolant-side heat transfer coefficient, which in turn causes the slope of the coil condition curve to decrease such that the ratio of latent t sensible heat transfer decreases below that for full load. As the throttling of the coolant proceeds, a higher and higher humidity ratio results. However, it has already been established that during part load steeper coil condition curve is required to accommodate the increased latent to sensible heat load ratio.

(b) Coolant Flow Rate and Variable Air Volume (VAV) Systems

In the case of a VAV system the leaving supply air temperature is generally kept constant and the flow rate of air is reduced as the total load reduces. As for the constant air volume system the coolant flow is throttled to maintain constant supply air temperature as the load diminishes and again this tends to reduce the slope of the coil condition curve. Provided the coil surface temperature remains below the dew point temperature of the air, this effect is partially offset by the reduction in the air flow rate because the air takes a longer time to pass through the coil and a greater proportion of it is cooled sufficiently for condensation to occur. The combined result of these two opposing influences is that throttling of the coolant flow rate at part load causes the coil slope of the condition curve in a VAV system to be reduced but to a less marked degree than that in a CAV system. Reducing the coolant temperature rise and/or lowering the coolant supply temperature are additional means by which the steepness of the coil condition curve may be controlled.

(ii) Dehumidifier Size

The mismatch which exists between the size of the dehumidifier coil selected for full load design conditions and the actual load to be offset at part load conditions constitutes the major difficulty which is overcome by this invention.

It is not uncommon for an air conditioning system to be required to satisfy a part load condition which is 40% or 30% of the full design load. Existing practice appears not to appreciate the serious consequences which arise when a dehumidifier, which is properly sized for a peak design load, is required to perform for part load conditions. It is rare for part load performance to be specified by consulting engineers. At low load conditions the coolant flow rate through a given coil, which for such conditions is disproportionately large in relation to the magnitude of the load, drops to a trickle. Inevitably, the heat transfer coefficient of the tubes reduces to a small value and the coil surface temperature increases.

The reduction in the coolant side heat transfer coefficient occurs both with liquid flow coolants such as chilled water and with liquid and vapour flow coolants such as refrigerant R12 or R22. In the latter case a number of flow patterns occur depending on the mass fraction of liquid, the fluid properties of each phase and the flow rate. A good understanding of the effect of low mass velocities of refrigerants on the heat transfer coefficient is presented in FIG. 20 ASHRAE Handbook 1981 Fundamental published by American Society of Heating Refrigerating and Air-Conditioning Engineers Inc., Atlanta, Ga., U.S.A., on p 2.31. It is there clearly demonstrated that a drop in the mass flow rate of the refrigerant to 40% of the peak mass flow rate shown is associated with a drop of up to 34% in the heat transfer coefficient.

For a large proportion of the coil the surface temperature may become greater than the dew point temperature of the air to be treated, with a consequent loss of dehumidification. For this second reason, the slope of the coil condition curve of a conventional air conditioning system at part loads becomes shallow just when it is required to become steep, despite the steepening effect of a drop in face velocity through the coil.

(iii) Secondary to Primary Surface Area Ratios, (Fin Density)

The lower the temperature of the wetted outside surfaces of the coil the greater will be the condensation of water vapour on those surfaces. Fins, or secondary surfaces, have a higher surface temperature than do the tubes, or primary surfaces. As fin density increases, the average fin temperature also increases and the Reynolds number of the air flow between the fins decreases, so decreasing the heat and mass transfer coefficient. By having a large proportion of primary surface area, the dehumidification per unit of surface area will be large, but if taken too far, this consideration would lead to coils with many rows of depth which do not make efficient use of the material of which they are made. Thus there is an optimum ratio of secondary to primary surface which gives the best use of material in achieving the required degree of dehumidification for a given application. Seeking to reduce coil depth by using very high fin density is poor practice. While it may result in a small reduction in size and therefore first cost of the dehumidifier, there is firm evidence that it inhibits dehumidification and hence compromises part load performance. The slope of the coil condition curve will decrease, performance will be impaired and fan power requirements will be increased because of the higher resistance offered to the air flow by the high fin density.

Performance

The variable air volume (VAV) system is frequently employed in air conditioning design, especially when energy savings and space savings are considered. However the system has often been widely criticised by building occupants, since performance does not come up to expectations under part load conditions. One article in the 1983 (Sept.) ASHRAE Journal, (Tamblyn), with reference to new VAV systems, lists complaints of "... stale air and lack of air motion..." and reports that "Owners are fighting back in energy consuming ways by raising outside air ratios, operating fans longer and setting minimum airflows which demand the use of the same reheat that was formerly eliminated".

Reference can also be made to the August 1987 ASHRAE Journal, page 22 wherein the problems of VAV systems are discussed in detail. These are listed as uneven temperatures, lack of temperature and humidity controls, lack of air motion, lack of fresh air, and unsatisfactory energy savings. Reheating is even recommended in that article. Further, it has been suggested therein that only interior zones should be serviced by VAV systems.

A typical VAV system which is particularly advantageous in conserving both space and energy is an installation in a high rise office block with air handling units on each floor. The need for large shaft spaces and long duct runs is eliminated since each air handling unit is located on the floor it serves. It is conventional to utilise the ceiling space as a large return air plenum. If such a building is located in a city, such as Melbourne, Australia, or Dallas, Tex., the system will be designed to operate when there is a high outside air dry bulb temperature, say 95° F. (35° C.) and a low humidity during summer peak design conditions. During part load days and marginal weather conditions when the ambient dry bulb temperature is less, there are numerous periods during which the humidity ratio is considerably above the summer peak conditions. A typical minimum fresh air intake is the equivalent of 15% of the total peak design airflow rate. Since the minimum fresh air intake for meeting ventilation requirements is a fixed quantity, at 60% part load the requirement for outside air is (15/0.6)%, i.e. 26%, and at 30% part load 50% outside air is required. Thus the dehumidifier is burdened on humid part load days not only with an outside air humidity ratio condition which is higher than that at peak loads, but also with a higher percentage of outside air. Frequently this demand is beyond the capability of the conventional VAV system which largely accounts for the many complaints that the atmosphere is "humid" or "stuffy".

The several difficulties described above are overcome primarily in this invention by controlling the flow of coolant through the coil in such a way that a high coolant flow velocity is present in a sufficient portion of the coil to ensure that there is sufficient dehumidification capacity at all load conditions. One preferred strategy is to increase the coolant flow rate through portion of the dehumidifier as it is reduced through other portions.

Each portion may be independent in its design and arrangement; that is, each portion may have a different circuiting, different fin density, different rows of depth, different geometry. Thus each coil can have different coolant temperature rises across different portions. Thus another strategy is to select coils such that active portions of coil have low coolant temperature rises in order to increase dehumidification at desired fractional load conditions.

By this means it is possible to increase the slope of the coil condition curve, which then approximates a straight line, while reducing the total capacity of the unit.

The difficulties associated with "humid" or "stuffy" conditions within an air conditioned space (when under part load), are resolved in this invention by maintaining a sufficiently high level of the air velocity to ensure adequate ventilation, maintenance of the Coanda effect in the outlet registers supplying air to the air-conditioned space and air movement within the space.

PRIOR ART

As far as is known to the applicants no prior art exists wherein under part load conditions the coil condition curve will become sufficiently steep to satisfy closely the sensible and latent heat loads in the ratio in which they occur.

Reference however may be made to the ASHRAE Transactions 1982 (Shaw) and the corresponding U.S. Pat. No. 4319461. That reference indicated that face velocity of moist air influences part load performance. As the Reynolds number and face velocity are reduced, the slope of the coil condition curve becomes steeper and the curvature of the coil condition curve reduces towards that of straight line.

This matter was further dealt with by Shaw in Proceedings of the Seventh International Heat Transfer Conference, Munich F.D.R., V.6, Hemisphere Publishing Corp. Washington D.C. Relevant information is also contained in the aforesaid September 1983 ASHRAE Journal in an article entitled "Beating the blahs for VAV", by R. T. Tamblyn. Finally, reference may be made to an article by Shaw aforesaid, and Professor R. E. Luxton, 1985 "Latest findings on airstream velocity effects in heat and mass transfer through dehumidifier coils" (Proceedings of Third Australasian Conference on Heat and Mass Transfer, at Melbourne University, published by E. A. Books, St. Leonards, N.S.W.).

BRIEF SUMMARY OF THE INVENTION

In this invention, an air conditioner dehumidifier comprises coil portions cooled for example by chilled water or refrigerant. Under part load conditions, restriction of coolant flow below peak load flow, or its total elimination, is limited to some only of the coil portions, while the remainder may receive as much or more coolant flow as at peak load conditions. The relatively unrestricted coolant flow through this remainder can be greater than that under peak load conditions due to more pump output being available to supply the reduced active size of the coil. Furthermore the relatively unrestricted coolant flow through the active portions, can be greater, (or less), than that under peak load conditions by presetting the control system to open, (or close), the coolant throttling valves at designated air conditioning loads. In this invention there is more than one control valve. Each control valve is associated with at least one of the portions of the coils that make up the total coil system. The control strategy to offset the full range of load variation may involve some valves which are not fully open during peak loads and some valves which are fully open during part load and some valves that remain fixed at some part open condition during a portion of the operating range of the system.

In many instances the coolant flow through the coil portions of the dehumidifier will be entirely unrestricted. However, the invention will usually (but not always) involve at least one valve for each coil portion of the total coil system. The control strategy to effect the full range of load variation may, and often will, involve some valves which are, and some which are not, fully open at part load conditions, during a portion of the operating range of the system.

More specifically, in this invention an air conditioner is characterised by a dehumidifier which comprises a plurality of coil portions, valves selectively controlling flow of coolant from the supply means through the coil portions, and coupling means coupling the valves to the sensor in such a way that, as load diminishes from peak conditions to part load conditions, coolant flow through a coil portion is restricted by a said valve thereby reducing heat transfer of that portion, but flow through the remainder of the coil portions remains sufficient to maintain dehumidification.

The result is that the effective size of the dehumidifier is reduced for part loads, and more coolant is available to increase dehumidification.

The "design condition" is a somewhat arbitrary condition for an air-conditioned space, but usually in a narrow range of temperature from 22° C. to 26° C. and a narrow range of humidity from 35% to 55%. This invention provides a much better capacity to offset load requirements to meet these conditions in the correct proportion of sensible and latent heat loads throughout the range from minimum to peak loads.

A further aspect of this invention is that the velocity of air flow through the dehumidifier coil or coils is characteristically less than that through the dehumidifier coil or coils of a conventional system. As a consequence of this, fan power consumption is significantly less, and noise levels are similarly significantly less, than for a conventional system.

BRIEF SUMMARY OF THE DRAWINGS

An embodiment of the invention is described hereunder and is illustrated in the accompanying drawings in which:

It will be clear that there are many instances wherein valve restrictions are necessary as indicated in FIG. 4, for example, wherein an oversized air conditioning plant is installed in anticipation of building additions. In many instances it is necessary to restrict partly the flow of coolant through the dehumidifier even under peak load conditions, and therefore often restrictions to coolant flow described hereunder must be regarded as relative restrictions. For example, in the dynamics of air conditioning requirements environmental considerations are foremost factors in determining dehumidifier selection. As an illustration, in a climate which is dry during peak air conditioning loads such as Melbourne, Victoria and Dallas, Tex., there is no need for maximum coolant flow during peak air conditioning periods and therefore coolant flow may be partially restricted whereas there is good reason for the least restriction to coolant flow during part load but humid conditions. FIG. 4 graphically indicates this effect.

Figure 4:
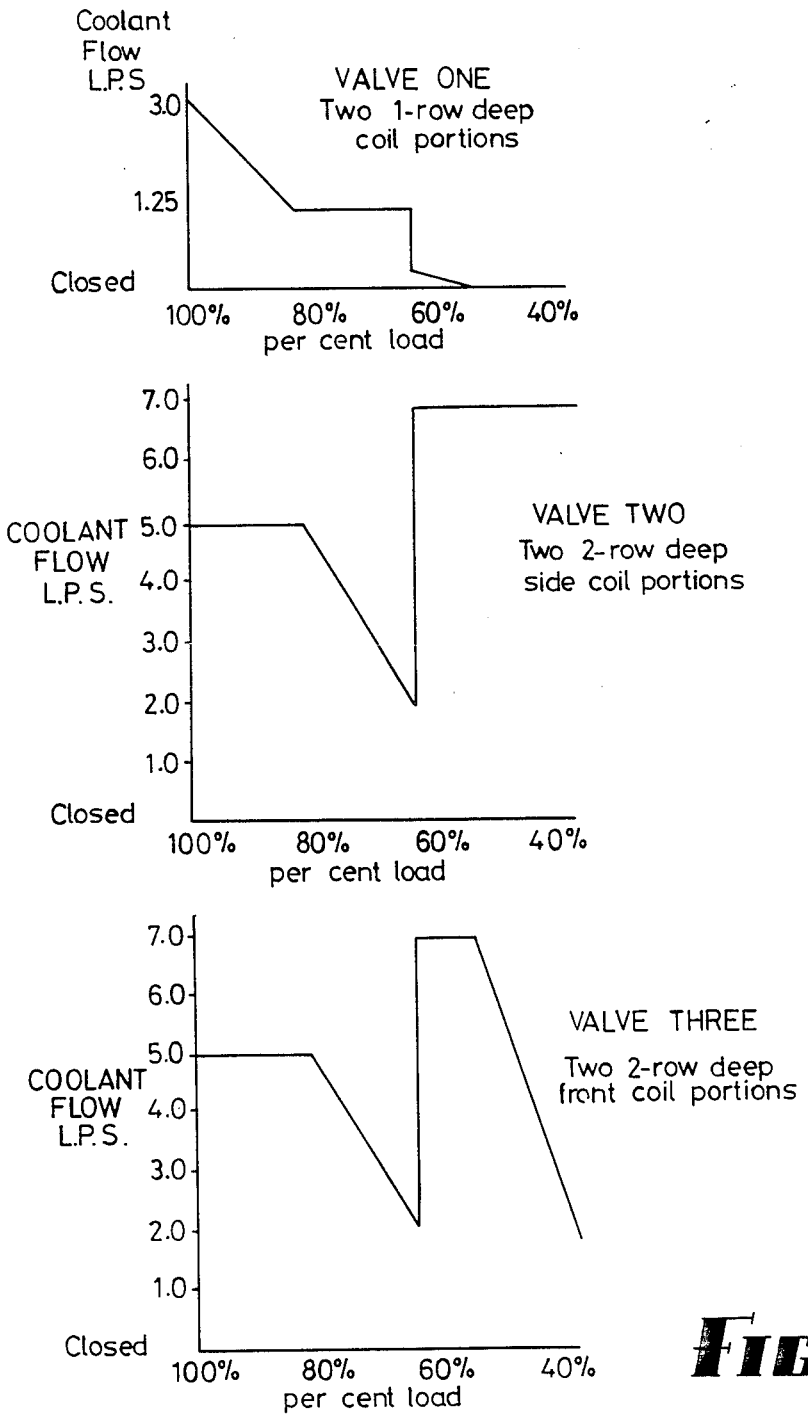
FIG. 4 shows graphically the control of valves over a range of loads in one installation wherein the dehumidifier comprises two coil portions acted upon by a single valve and two further coil portions acted upon by separate valves.

In the example demonstrated by FIG. 4 there is included a very important aspect of this invention not available to conventional systems. Each portion of the total dehumidifier complex has the advantage of being able to employ different circuiting, different fin density, different rows of depth, and/or different geometry in order to enhance performance during particular air conditioning fractional load conditions. Thus this invention offers choice in both size and variation in performance characteristics which makes possible the best fit over the full air conditioning load range. This too influences restrictions of the coolant flow.

Thus it can be seen that there are numerous special considerations, as described above, which may support or oppose the general load characteristics which prevail during reduced load performance. It is these special considerations which are related to the use of the term "relative" restrictions.

The total coil complex in this invention is divided into coil portions to allow reduction of the effective size of the total coil as air conditioning loads reduce below the peak loads in such manner that during these part loads the coolant velocity through the remaining active portions of the coil complex may be increased to maintain or augment the dehumidification capacity of the coil system. It is in this manner that a coil condition curve during part load is obtained which satisfies the general load characteristic and the increasing ratio of latent heat to sensible heat load characteristic which develops during part loads. A steeper slope to the coil condition curve results and the curvature of this curve reduces towards that of a straight line with reducing face velocity and with increasing coolant velocity and reducing coolant temperature rise. In this invention the range of the active size of the coil complex is matched to the operating range of the coil at all conditions of load from peak to minimum. The conventional method is very different since as the load reduces no matter what performance is desired, the coolant velocity reduces and the active size of the coil is constant. When compared with peak coolant conditions according to this invention, as indicated in FIG. 4, at 37% of peak air conditioning load, 32% of the coil is active with 65% of the coolant flow through the valves; at 53% of peak air conditioning load 67% of the coil is active with 110% of the coolant flow through the valves. Clearly in this invention the active size of the coil as load reduces is not necessarily proportional to the valve restriction of the coolant flow. The ideal aim in this invention is to reduce the active size of the dehumidifier as the air conditioning load reduces and simultaneously to reduce face velocity, increase the coolant velocity, decrease the coolant temperature rise where possible in order to offset the sensible and latent heat loads in the same proportion at which they occur during the full range of loads encountered from peak to minimum.

Figure 1:
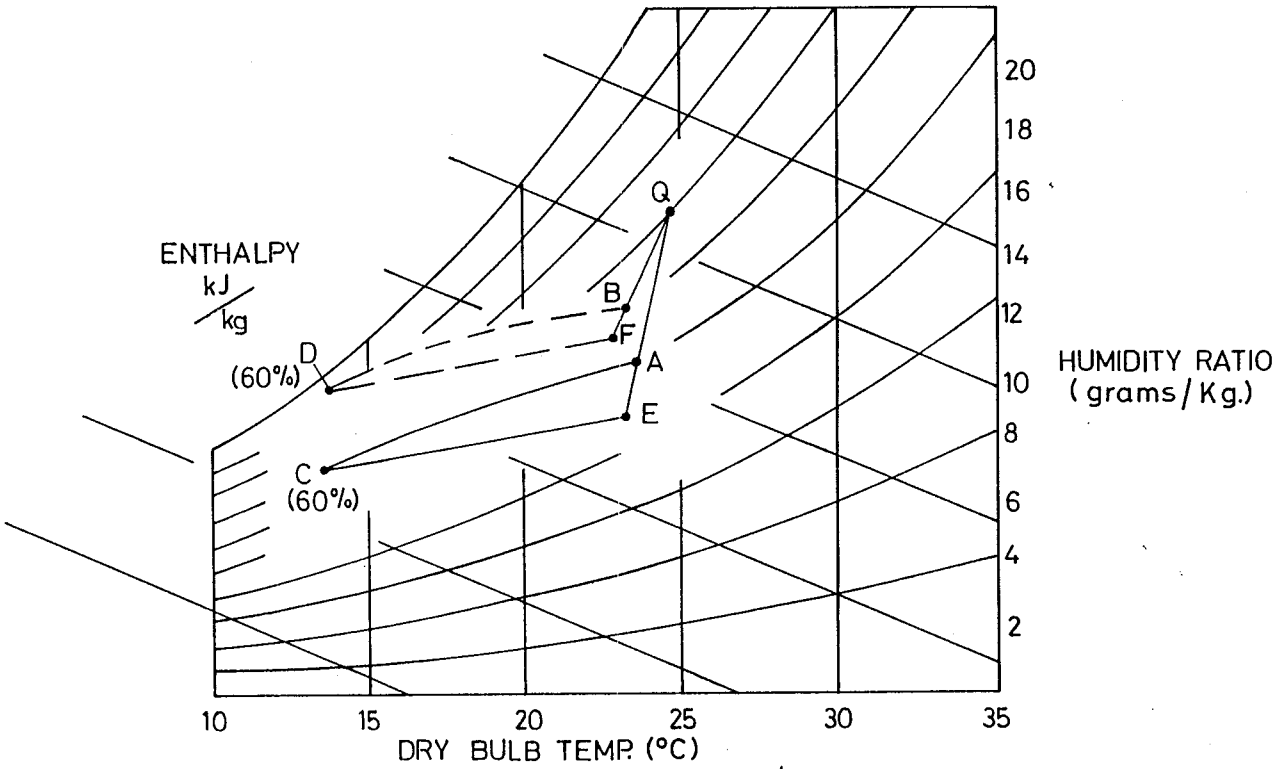
FIG. 1 is a simplified psychrometric chart illustrating the coil condition curves and the load ratio lines for variable air volume equipment used under conventional conditions (broken lines) and in accordance with this invention (unbroken lines)
Figure 2:
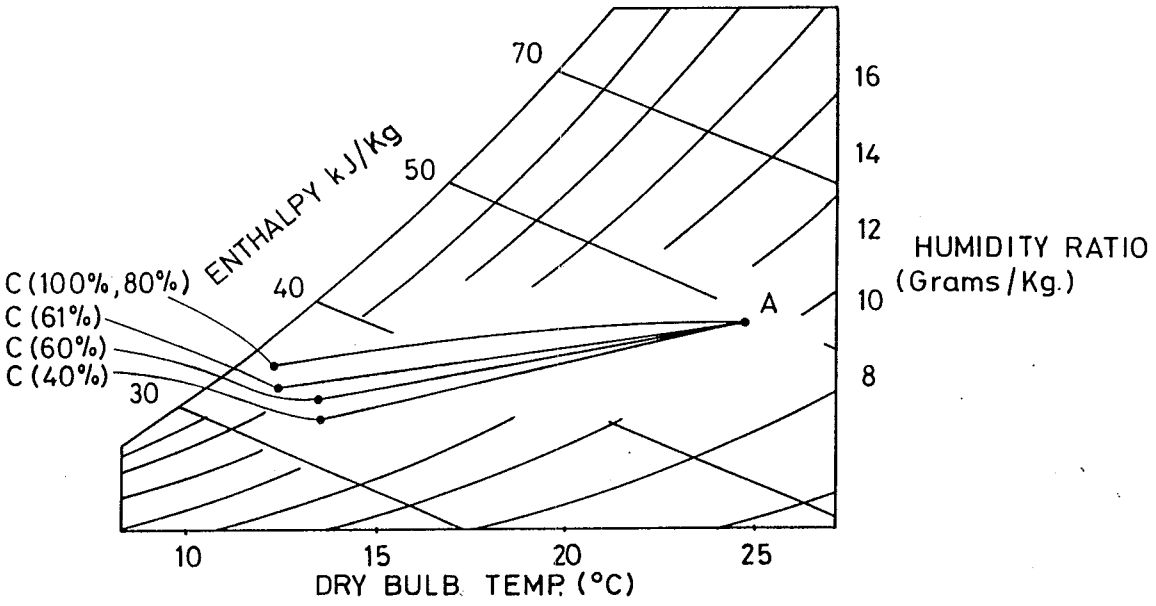
FIG. 2 illustrates the coil condition curves when the invention is used in similar sized equipment, and as described hereunder, under different percentages of load (100% and 80%; 61%; 60%; and 40%)

FIG. 1 shows a comparison between VAV conventional systems and VAV systems according to this invention at the same part load conditions. FIG. 2 shows increasing dehumidification with decreasing loads for a VAV system according to this invention.

Reference is now made to FIGS. *3a*, *3b* and *3c*.

In FIG. *3a*, a heat exchanger (chiller) 10 has one circuit cooled by a refrigerant from a refrigeration plant (not illustrated) and its other circuit contains chilled water or some other coolant. The chilled water is pumped by the water pump 11 into two conduits 12 and 13 which feed chilled water to the first coil portion 14 and the third coil portion 15 of a dehumidifier 16 composed of coil portions 14, 15 and 17. The second coil portion 17 of dehumidifier 16 is fed by a bridging conduit 18 from the outlet side of the third coil portion 15. It must be emphasised that this embodiment is only exemplary of the invention and a wide range of configurations within the invention is available to a designer.

There is provided an electronic control designated 20, this being ideally a direct digital control for controlling three valves designated 21, 22 and 23, each valve being operated by a respective solenoid, drive motor or other means, all solenoids or drive members being designated 24.

The electronic control 20 also functions to control a fan 26 which draws air through a filter 27, through the dehumidifier 16, and discharges to the zones 28, one of which is illustrated in FIG. *3a*. Each zone 28 contains a baffle 29 controlled by a thermostat 30 in accordance with usual construction.

The manner in which the valves 21, 22 and 23 function is as follows:

Full Load

Chilled water is pumped by pump 11 through conduit 12 and the first coil portion 14, through open valve 21 and back to the heat exchanger 10. Chilled water also flows through the conduit 13, the third coil portion 15, conduit 18, the second coil portion 17 and through the valve 22 which is open, and also to the chilled water return line to the heat exchanger 10. The valve portion 23 is closed.

In the transition from full load to part load (60%) during the next phase, the valve 22 throttles as valve 23 opens, and as this occurs there is a gradual reduction of coolant flow through the second coil portion 17.

Part Load (60%)

The valves are operated, under control of electronic control 20, by their respective solenoids 24 to drive members to occupy the conditions shown in FIG. *3b*. There is a full coolant flow through the first coil portion 14 through the open valve 21, no coolant flow through the second coil portion 17 because of the closed valve 22, and full coolant flow through the third coil portion 15 because of the open valve 23. This condition is shown on FIG. 2 as C 60%, C indicating the leaving condition of the air from the total dehumidifier complex 16 in accordance with the invention. This should be compared with C 100% (indicating 100% load), 61% (indicating the condition during transition), and C 40% (indicating the condition described below at 40% load). However the condition shown for 60% load corresponds approximately to the full lines in FIG. 1 which is discussed below.

Transition Part Load 60% to 40%

Valve 22 remains closed and valve 23 remains open. Valve 21 throttles towards a closed position, and valve 23 remains open. The coolant flow through the first coil portion therefore is slowly restricted, until at 40% part load it closes altogether.

Part Load at 40%

The 40% part load condition is shown in FIG. *3c* wherein valves 21 and 22 are both closed, while valve 23 is open, and therefore the coolant flow is solely through the third coil portion 15. If (as illustrated) the water pump 11 is a centrifugal pump, because of its inherent characteristics the flow through the third coil portion 15 will be greater than under full load conditions so that additional dehumidification will occur in coil portion 15 and this further assists in increasing the slope of the coil condition curve to the point marked C 60% as shown in FIG. 1. (In addition, in general, as shown in FIG. 4, the coolant flow can be increased by the control system 20 to be preset to open any particular valve to any desired position.)

Part Load from 40% to 30%

Figures 3B, 3C, 3H:
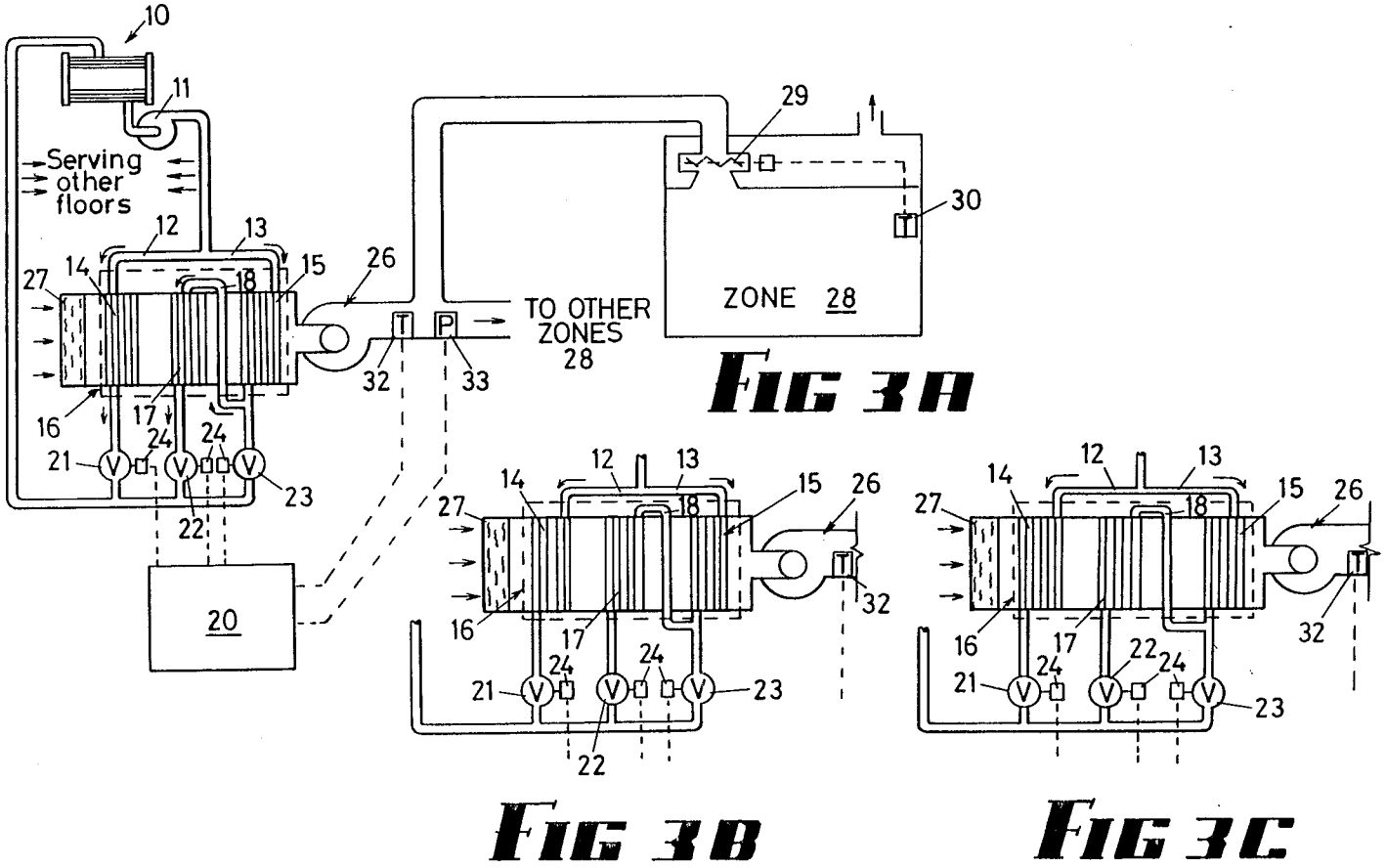
FIG. 3 illustrates the equipment by which the results shown in FIGS. 1 and 2 may be achieved, FIG. 3*a* indicating an entire installation under full load, FIG. 3*b* under part load (60%) and FIG. 3*c* under part load (40%)

Valves 21, 22 and 23 remain as shown in FIG. 3c, but valve 23 throttles so as to reduce coolant flow through the third coil portion 15.

Minimum Part Load at 30%

In the minimum position, valve 23 is nevertheless partly open to allow a reduced coolant flow through the third coil portion 15.

All the above functions are shown in tabular form in Table 1.

As said above, one of the problems encountered with variable air volume systems (VAV) is that under very low load conditions the zone to be cooled and dehumidified becomes stuffy and unpleasant due to insufficient ventilation. The fan speed (or other air flow speed control) is controlled by the supply thermostat 32 and the air flow rate gauge 33, and in order to ensure a minimum volume air flow rate which will nevertheless provide adequate ventilation, the dry bulb temperature is raised by between 1° and 3°, as seen in Table 1. This is achieved by means of the digital control device 20 as described hereunder. The percentage load can be determined by any one of the known procedures presently in use in air conditioning, and in this embodiment of the gauge 33, in a manner already in common use.

The gauge 33 may require modification where the enthalpy difference of the airstream across the dehumidifier varies considerably, since this is also a factor in fractional load.

tal controller 41 which controls digital/proportional interface 42 which in turn controls valves, 21, 22 and 23, which are shown in FIG. 3. The direct digital controller responds to return air temperature 43, supply air temperature 44 and supply air pressure 45 and to feedback from the three valves via lines 46, 47 and 48. The manner in which electronic control 20 accomplishes its function is shown in the flow chart of FIG. 6. This flow chart, together with the accompanying legend, is believed to be self explanatory. For further explanation of abbreviations used in FIGS. 5 and 6, the following is provided:

TSA= supply air temperature
TRA= return air temperature
PSA= supply air pressure
TSA STPT= supply air setpoint
V = chilled water valve. The electronic control 20 (FIG. 3A) can be any one of a number of readily available electronic controls for air conditioning purposes but in this embodiment comprises a controller and interface system respectively designated C500 and N500, and in combination DSC1000, available from Johnson Control Products Division, 1250 East Diehl Road, Naperville, Ill.

Reference is now made to FIGS. 1 and 2 which graphically illustrate the advantages of the invention.

In FIG. 1, the dashed line B-D indicates the coil condition curve and the dashed line F-D indicates the load ratio line resulting at part load according to conventional control strategy. The slope of the load ratio line F-D is determined by the ratio of the latent to the sensible heat loads to be offset. Its position, however, is determined by the state of the air after it leaves the dehumidifier.

The designation Q indicates an example state of out-

TABLE 1

| | | | LFV-VAV Coil Control Sequence | | | | | | | | | |
|---|---|---|---|---|---|---|---|---|---|---|---|---|
| | | | | OUTSIDE AIR (DESIGN) | | | RETURN AIR CONDITION | | | AIR LEAVING AHU | | |
| | VALVE 21 | VALVE 22 | VALVE 23 | Part of Total Air | DBT F/°C. | WBT F/°C. | Part of Total Air | DBT F/°C. | WBT F/°C. | DBT F/°C. | WBT F/°C. |
| FULL LOAD (3 rows active) (See FIG. 3a) | OPEN | OPEN | CLOSED | 0.15 | 95.0/ 35.0 | 69.8/ 21.0 | 0.85 | 75.9/ 24.4 | 62.6/ 17.0 | 56.1/ 13.4 | 53.6/ 12.0 |
| PART LOAD TO 60% | OPEN | THROTTLES | CLOSED | | | | | | | | |
| PART LOAD AT 60% (See FIG. 3b) | OPEN | CLOSED | OPEN | 0.26 | 77.0/ 25.0 | 68.5/ 20.3 | 0.74 | " | " | 57.7/ 14.3 | 54.1/ 12.4 |
| PART LOAD LOAD 60 TO 40% | THROTTLES | CLOSED | OPEN | | | | | | | | |
| PART LOAD AT 40% (See FIG. 3c) | CLOSED | CLOSED | OPEN | 0.38 | 68.0/ 20.0 | 66.2/ 19.0 | 0.62 | " | " | 60.1/ 15.6 | 55.4/ 13.0 |
| PART LOAD 40 TO 30% | CLOSED | CLOSED | THROTTLES | | | | | | | | |
| MIN. PART LOAD AT 30% | CLOSED | CLOSED | IN MINIMUM OPEN POSITION | 0.50 | | | 0.50 | " | " | | |

Figure 5:
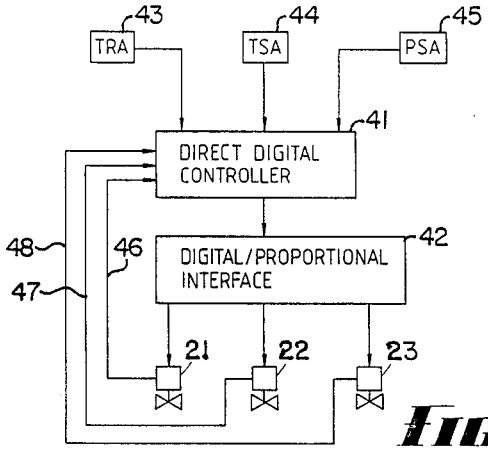
FIG. 5 is a schematic diagram setting out the electronic control for a low face velocity/variable air velocity installation.
Figure 6:
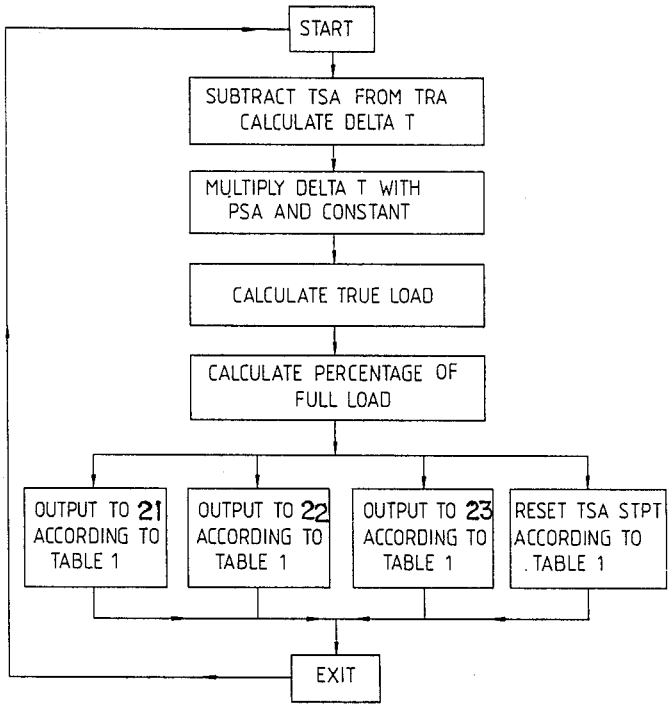
FIG. 6 is a software flow chart for the hardware of FIG. 5.

The schematic diagram and flow chart of FIGS. 5 and 6 set forth the electronic control 20 and its operation. The electronic control is comprised of direct digiside air under part load conditions. The line QF mixture of outside air with return air from the conditioned zone in the ratio of the lengths FB/QB.

In the example of FIG. 1, a conventional system is compared with the system of this invention, wherein both are at the same part load conditions. It is important to note that the ratio of FB/BQ will increase with further reduction in the part load condition as is indicated in Table 1, column entitled "Outside Air—Part of Total Air". Thus for the same outside air condition, point Q, point B will rise to a still higher humidity ratio, further magnifying the problem. The system according to the invention will satisfactorily achieve the specified condition at even the lowest part load conditions.

The designation B indicates the point at which mixed air enters the dehumidifier according to conventional control, the designation D indicating the air condition as it leaves the dehumidifier and the designation F indicating the actual average zone condition achieved under conventional control conditions. This should be compared with the full lines where, according to the invention, the mixed air enters the dehumidifier at the point A, the leaving condition of the air from the dehumidifier according to the invention is at the point C, and the average zone condition of the air by the invention is shown at point E, this being the average zone desired condition under part load. The upper full line is the coil condition curve in accordance with the invention and the lower full line the load ratio line in accordance with the invention.

Conventional systems, with the shallow coil condition curve characteristics illustrated in FIG. 1, do not achieve a leaving condition from the dehumidifier which is even reasonably close to point E, even if the air entering a conventional system is initially at point A.

To explain further, it is to be noted that conventional part load performance will result in a coil condition curve slope which is shallower than the slope of the full line A-C of FIG. 1. As a consequence, the leaving condition will be above that of point C. Given the same room load ratio line slope as indicated by the full line C-E, the return air from the treated space will be at a higher humidity ratio than the desired point E. This return air, when mixing with the part load outside air at point Q will result in an entering condition to the dehumidifier which has a higher humidity ratio than at point A. Thus points A, C and E continue to ride up until an equilibrium point at which the slope of the coil condition curve B-D satisfies the required slope of the load ratio line D-F for the required quantity of outside air. This occurs when the slope of D-F equals the actual slope of the room load ratio line C-E at part load. Unfortunately, the air conditioning system has then failed in its major objective which is to achieve a space design condition reasonably close to point E. Instead, it has reached the frequently unacceptable condition of point F.

Line D-F (which will be parallel to line C-E) may not appear to end up in a condition which is too uncomfortable since point F may be classified as having a barely acceptable relative humidity of say 60% instead of the design target of 45%. This may be the case where a single zone is served by the air handling unit. However, consider the case when the variable air volume system is designed for a single air handling unit per floor serving all the zones. In these circumstances, F is not acceptable in lieu of the design condition at point E. Line D-F represents the *average* load ratio line from *all* zones and there will be some zones which will be much further from the design condition E than indicated by the average point F.

As said above, FIG. 2 also indicates the load ratio line under full and part load conditions, and FIG. 2 graphically illustrates how the load ratio line becomes steeper as the load decreases to 40%. It should be noted that at 40% load as indicated above and as indicated in Table 1 valve 23 controlling the coolant flow through the third coil portion 15 is at maximum velocity so that maximum dehumidification is available from the coil at that load.

The above description is for a very simple installation, and exemplifies the invention. However, in practice, it is somewhat unusual to encounter such a simple set of circumstances, and different coil control strategies will be required for different installations.

FIG. 4 graphically illustrates the control of valves over a range of loads wherein a dehumidifier comprises two, 2-row deep portions of a dehumidifier complex, each coil having its separate control valves 2 and 3. In addition there are two, 1-row deep portions making up the third row of depth to the two, 2-row deep portions described above. These two 1-row deep portions are served by the single control valve number 1. FIG. 4 clearly indicates the position of each of the control valves which acting together optimise performance from peak to minimum load conditions.

The mismatch which exists between the size of the dehumidifier coil selected for full load design conditions and the actual load to be offset at part load conditions is at the heart of the problem. Referring to FIG. 3, coil portions 14 and 17 are inactive when at this very low part load condition since valves 21 and 22 are closed. Thus the active coil portion 15 is enabled to have an increased coolant flow compatible with the face velocity and the high dehumidification requirement characteristic of part load conditions.

The above description relates to a decreasing load. The invention clearly extends to the reversal of conditions wherein the load increases from a fractional level up towards the design load condition.

SUMMARY

The main advantages of the invention are as follows:

(a) For both constant air volume and variable air volume systems, energy requirements are minimised and system performance optimised over the full range of sensible and latent heat loads.

(b) Noise is reduced under both part and full load conditions.

(c) The size of the coil which is active can be varied to match the actual load imposed and the active coil portions under part load conditions can have high coolant flow rates to offset increased ratio of latent heat to sensible heat, without overcooling. The water temperature rise over the coils may be less, also without overcooling of the air.

(d) The slope of the coil condition curve can be controlled to produce that load ratio line which is necessary to offset the sensible and latent heat loads in the proportion in which they occur while maintaining the required quantity of fresh outside air in the supply air to the conditioned space. In particular, the coil condition curve can be made steeper than for a conventional system, and can be made to approximate a straight line.

We claim:

1. An air conditioner comprising a dehumidifier, said dehumidifier comprising a plurality of coil portions, coolant supply means, conduits connecting the dehumidifier and coolant supply means in a coolant circuit, an air flow fan, means coupling the air flow fan and the dehumidifier such that the fan, in operation, causes air flow through at least some of the coil portions, at least one sensor downstream of the dehumidifier, valve means selectively controlling flow of coolant from the supply means through the coil portions, and valve coupling means coupling the valve means thereby reducing heat transfer of that portion, but flow through the remainder of the coil portions remains sufficient to maintain dehumidification, said valve means comprising some at least of a plurality of valves which are electrically operated throttle valves, a further sensor downstream of said air flow fan, air flow speed control means, and said further sensor being an air flow sensor, and means so interconnecting said electronic circuit, air flow sensor and air flow speed control means that, if air flow speed reduces to an insufficient ventilation velocity pursuant to load reduction, air flow speed is again increased by a preset signal from the control system which resets the supply air thermostat to a higher temperature thus decreasing the enthalpy difference across the coil condition curve and causing the air dampers associated with each zone to take corrective action by moving to more open positions and thus to increase the volume flow rate of the fan to result in sufficient ventilation.

2. A method of air conditioning comprising cooling a plurality of coil portions in a dehumidifier by pumping a coolant through those coil portions, urging air to flow through at least some of the coil portions by means of an air flow fan, sensing the temperature of the air downstream of the dehumidifier, restricting flow through at least one of the coil portions but leaving flow through the remainder of the coil portions unrestricted upon decrease of load which is sensed by the supply air thermostat as a drop in temperature, and limiting the minimum air flow velocity by identifying part load conditions wherein at a predetermined part load condition the thermostat operative temperature setting in the air flow downstream of the fan is increased.

* * * * *